United States Patent [19]

Parnell

[11] Patent Number: 4,694,965

[45] Date of Patent: Sep. 22, 1987

[54] MODULAR PANELS FOR A DISPLAY APPARATUS

[75] Inventor: Raymond Parnell, Cincinnati, Ohio

[73] Assignee: The Tomorrow Group, Inc., Cincinnati, Ohio

[21] Appl. No.: 907,877

[22] Filed: Sep. 16, 1986

[51] Int. Cl.[4] ..... A47F 5/08

[52] U.S. Cl. ..... 211/87; 52/36; 52/588; 211/189; 248/220.2; 248/222.2

[58] Field of Search ..... 211/87, 189, 59.1, 57.1; 248/220.2, 220.3, 220.4, 222.2; 52/36, 588

[56] References Cited

U.S. PATENT DOCUMENTS

| | | | |
|---|---|---|---|
| 4,323,163 | 4/1982 | Johns | 52/588 X |
| 4,420,087 | 12/1983 | Johns | 52/588 X |
| 4,450,970 | 5/1984 | Shepherd | 248/222.2 X |
| 4,531,331 | 7/1985 | Itagaki | 248/222.2 X |
| 4,603,068 | 7/1986 | Hunter | 52/588 X |
| 4,607,753 | 8/1986 | Radek | 248/222.2 X |
| 4,618,192 | 10/1986 | Kelley | 248/220.2 X |

*Primary Examiner*—Robert W. Gibson, Jr.
*Attorney, Agent, or Firm*—Wood, Herron & Evans

[57] ABSTRACT

Modular display panels adapted to interlock to form a vertical display for supporting and displaying articles are extruded from rigid plastic or aluminum in a one-piece cross section which comprises a plurality of spaced front flanges, a plurality of spaced back flanges and webs connected therebetween. The webs are angles relative to one another forming a channel therebetween in which hook elements are releasably mounted to support articles on the panels. The modular panels are interconnected to one another along their longitudinal edges so that a channel is formed which is identical to the channels on the panels thereby concealing the joints between the panels from view.

10 Claims, 3 Drawing Figures

MODULAR PANELS FOR A DISPLAY APPARATUS

BACKGROUND OF THE INVENTION

This invention relates to display apparatus, and, more particularly, to modular panels adapted to interlock with one another and mount on a vertical support wall to form a display.

The types of products displayed for sale at hardware shops, paint stores and a variety of other businesses are commonly supported on hook elements mounted to sheets of apertured boards known as "pegboard". Pegboard is fabricated from pressed wood fiber and formed with spaced apertures in an array of columns and rows. The hook elements which mount to the pegboard include one or a pair of upstanding prongs which extend through one or more apertures in the pegboard and rest against the back side of the sheet, and one or a pair of downwardly extending prongs which rest against the front face of the sheet.

Although pegboard has been used to display articles for several years, it has several disadvantages. One problem is that the downwardly extending prong of the hook element which rests against the front face of the pegboard can scratch or dent the front face, particularly when supporting a heavy item. The hook elements are also not positively locked onto the pegboard and can easily fall off when an article is removed. In addition, pegboard is usually only manufactured in sheets which are four feet wide and eight feet long, and the number and arrangement of holes which support the hook elements do not vary from one sheet to another. This limits the merchandiser's flexibility in varying the appearance of the display, and also limits the amount of product which can be supported on the display. The holes themselves are unattractive, and if the display requires more than one sheet of pegboard an unsightly seam is always present between adjoining sheets.

Pegboard is also relatively expensive because the sheets must be first formed in a pressing operation, and then the apertures are formed in a separate punching operation. The pressed board is not strong, and the four feet by eight feet panels are floppy and often must be secured at a number of locations to provide the necessary rigidity for supporting heavier items.

Improvements have been proposed in the prior art to solve some of the problems associated with pegboard displays. For example, various designs of one-piece cast or molded modular panels have been proposed, which are interconnected along their longitudinal edges and mounted to a vertical support to form a display. In some designs, the modular panels are formed with channels adapted to receive hook elements which support items for display.

Modular panels of the type described above are generally easier to manufacture than pegboard, provide for the support of hook elements with limited damage to the front face of the panel and allow for more flexibility in the design of a particular merchandising display because they are available in different lengths and the hook elements can be positioned in any desired intervals along the channels. Despite such improvements, prior art modular panels have several disadvantages.

One problem with modular panels of the type described above involves the manner in whch they are mounted to the vertical support wall. For example, the display apparatus disclosed in U.S. Pat. No. 4,531,331 requires each modular panel to be secured by screws or other fasteners to the vertical support wall along their longitudinal edges in order to provide sufficient strength and stability, even for vertical display of limited height. This adds time and cost to the installation procedure and increases the difficulty of installation because the longitudinal edge of each panel must be accurately aligned with the others to form a finished display with straight edges. Affixing each panel to the vertical support wall also presents problems in changing from one display design to another because the screws or fasteners supporting all the panels must be taken out and then moved to another location to vary the appearance of the display.

Other modular panels require stiffening elements and fasteners between adjacent panels in order to provide sufficient rigidity and stability. For example, U.S. Pat. No. 4,450,970 discloses modular panels made of sheet metal which are spot-welded to one another along their longitudinal edges and then connected to rear stiffening elements for added reinforcement to form a display. This not only adds to the cost of the display apparatus, but results in an essentially permanent arrangement of the panels since they cannot be separated from one another after the welding operation.

Still other modular, interlocking panels are unacceptable in appearance when connected together to form a display. Many prior art panels are mounted to the vertical support wall so that the screws or other fasteners are visible. In other modular panel designs, the joint formed between adjacent panels is also not hidden from view, detracting from the overall appearance of the display. The channels or slots which recieve hook elements in many panels are angled in such a manner that dust and other debris can collect therein, requiring regular cleaning or dusting.

SUMMARY OF THE INVENTION

It is therefore among the objectives of this invention to provide one-piece modular panels adapted to interlock to form a display which are attractive in appearance, which provide a strong, stable support without stiffening elements, which are easily mounted to and removed from a vertical support, which positively mount hook elements so that they do not easily fall off of the panels and which provide for flexibility in the arrangement of different displays of products.

These objectives are accomplished in a one-piece modular panel extruded from rigid plastic or aluminum in essentially any desired length. The cross section of each panel includes front and back flanges connected together by spaced ribs or webs which provides sufficient stiffness and rigidity to support even heavy items without additional reinforcing elements. The webs extend at an angle from one another to form spaced channels on the front face of the modular panel which positively lock hook elements for mounting articles upon the panel. In forming a vertical display comprising a number of interconnected modular panels, the uppermost panel in the display is affixed to a vertical support, and subsequent panels are releasably mounted to one another along their longitudinal edges so that each panel hangs from the panel immediately above.

In a presently preferred embodiment, each modular panel is extruded from polyvinylchloride to form a one-piece panel of approximately six inches in width and essentially any desired length. Each panel includes a back face comprising a plurality of spaced, planar back flanges. First and second ribs or webs extend outwardly along the length of each of the back flanges, at an angle relative to one another, to form a channel therebetween. The front face of each panel is formed of a plurality of spaced front flanges which are oriented substantially parallel to the back flanges. The front flanges are connected to the first web of one of the back flanges and the second web of an adjacent back flange to form the one-piece cross section.

Adjacent panels are joined along their longitudinal edges by an interlocking structure formed on the lowermost back flange at one end of each panel, and the uppermost front flange at the opposite end of each panel. In a presently preferred embodiment, an elongated first leg is connected to the lowermost back flange which extends outwardly at an acute angle relative thereto along the entire length of the panel. A second leg is connected to the uppermost front flange which extends inwardly therefrom and generally parallel to the web connected to the uppermost front flange forming a slot between the second leg and the web.

A number of modular panels are interlocked along their longitudinal edges to form a vertical display of essentially any desired height or length. In mounting one modular panel to another, the first leg of the lowermost back flange of an upper panel is inserted into the slot formed at the uppermost front flange of a lower panel so that the second leg of the lower panel interlocks with the first leg of the upper panel. The lower panel is thus supported along the length of its longitudinal edge and hangs downwardly from the panel above. For vertical displays of substantial height, it is preferable to either fix the panels to one another or to the vertical support to avoid buckling of the display. The panels may be connected to one another by applying tape therebetween along their mating longitudinal edges or by similar means of fixation. The panels may be connected to the vertical support by screws or other fasteners extending through the lowermost back flange.

Preferably, the first leg on the lowermost back flange and the second leg on the uppermost front flange of each panel are formed such that upon mounting one panel to another, a channel is formed at the joint between the two panels which is identical in appearance to the other channels formed by the webs along the front face of each panel. This hides the location of the joints between adjoining panels and enhances the appearance of the overall display.

In a presently preferred embodiment, a portion of each front flange overlies one of the channels defined by the webs connected to the back flanges forming overhanging, retention lips. Hook elements are provided comprising an elongated support portion, usually formed of wire, which is connected to a mounting block. The mounting block has a front face, and an upright leg portion which conforms to the cross section of the channels in each panel. The hook elements are releasably mounted to the panels by inserting the upright leg into the channel at an angle, past the retention lip of one of the front flanges, and then pivoting the hook element downwardly so that the upright leg engages the back of the retention lip and the front face of the mounting block rests against a front flange of the panel. The upright leg of the hook elements becomes wedged between the retention lip and the walls of the channel formed by the webs and back flange which positively locks the hook elements in place.

In another aspect of this invention, a ceiling bracket and base plate are provided for use with a plurality of modular panels to form a display along a vertical support such as the wall of a room. The ceiling bracket is fastened by screws or nails to the top of the vertical support wall and is formed with an elongated leg, identical to that of the first legs on the lowermost back flanges of each panel, for insertion within the slot formed by the second leg of the uppermost panel in the display. Such uppermost panel is mounted to the ceiling bracket by interlocking its second elongated leg with the leg on the ceiling bracket, and the remaining panels are connected to one another as described above. None of the panels are directly connected to the vertical support and thus can be easily installed and removed.

If the panels are extended to the floor or base of the vertical support wall, the base plate is employed which interlocks with the lowermost panel of the display covering its lowermost back flange. The base plate is formed with legs adapted to snap fit within the channels formed in the panel to secure it in place.

DESCRIPTION OF THE DRAWINGS

The structure, operation and advantages of a presently preferred embodiment of this invention will become further apparent upon consideration of the following description taken in conjunction with the accompanying drawings, wherein.

DETAILED DESCRIPTION OF THE INVENTION

Figure 1:
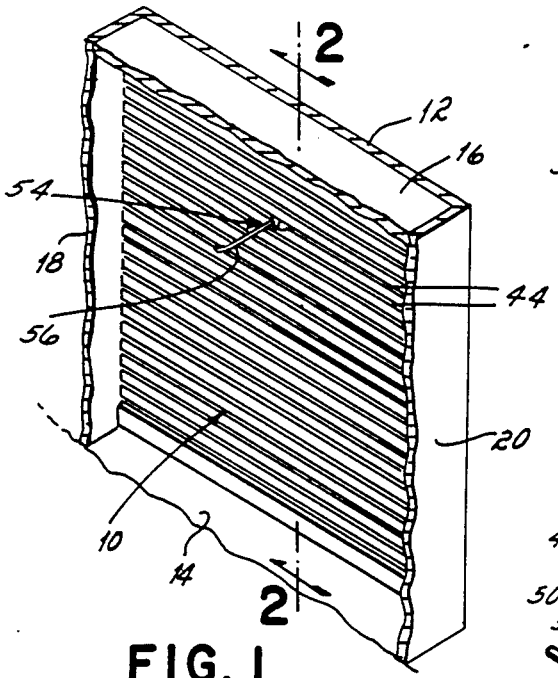
FIG. 1 is a perspective view of a vertical support wall having a number of modular panels of this invention interconnected to form a display mounted thereto.

A display 10 constructed of a number of modular panels, described in detail below, is shown mounted to a vertical support wall 12, which, in FIG. 1, is an end wall of a room having a floor 14, ceiling 16 and sidewalls 18, 20. In this embodiment, the display 10 extends between the floor 14 and ceiling 16 of a room. But as will become apparent below, displays formed by the panels herein can be mounted to a variety of vertical supports and are readily variable in height and length depending upon the requirements of a particular application.

Figure 2:
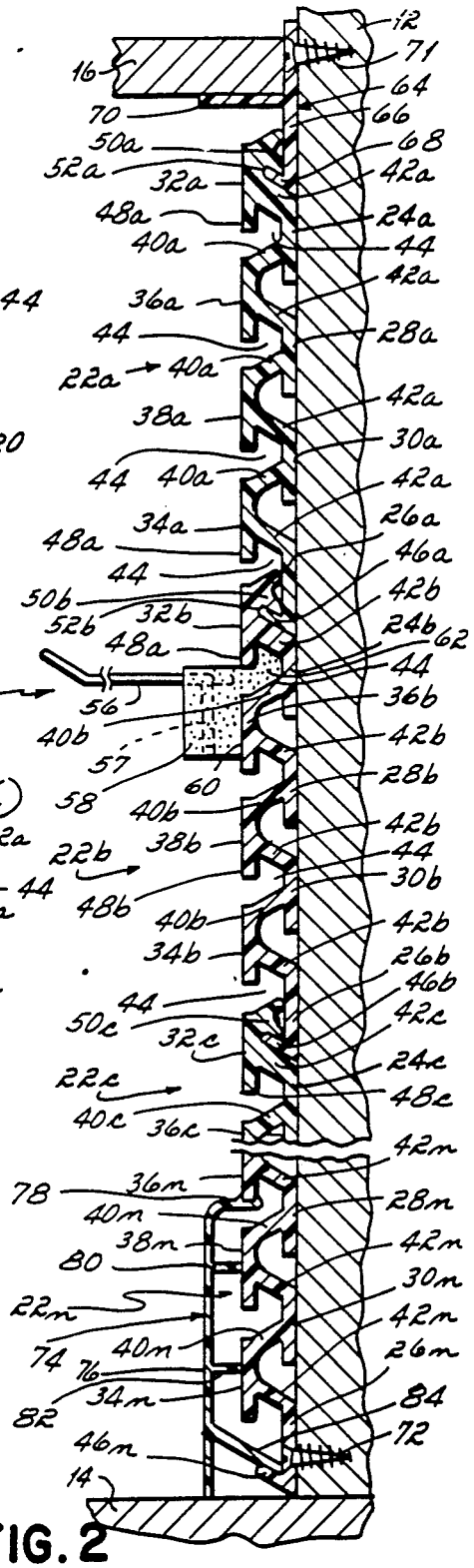
FIG. 2 is a cross sectional view taken generally along line 2—2 of FIG. 1 showing a number of the modular panels including a hook element, ceiling bracket and base plate.

A plurality of modular panels 22*a, b, c, n* form the display 10. The panels 22*a–n* illustrated in FIG. 2, are identical to one another in construction and thus the same reference numbers will be used to identify the same structure of each panel.

Modular panel 22*a* comprises an uppermost back flange 24*a*, a lowermost back flange 26*a* and two intermediate back flanges 28*a*, 30*a* therebetween. The back flanges 24*a* –30*a* are evenly spaced from one another and each has a planar rear surface. In the embodiment shown in FIGS. 1 and 2, the back flanges 24*a*–30*n* rest directly against the vertical support wall 12, but other vertical supports could be employed wherein only a portion or none of the back flanges contact the support. As discussed below, the cross section of panel 22*a* provides a strong, rigid section which requires little support.

The modular panel 22a also includes front flanges which are spaced from and extend generally parallel to the back flanges 24a–30a. The front flanges include an uppermost front flange 32a, a lowermost front flange 34a and two intermediate front flanges 36a, 38a therebetween. The front flanges 32a–38a are connected to the back flanges 24a–30a by webs which extend outwardly from the back flanges 24a–30a. The uppermost back flange 24a, and both of the intermediate back flanges 28a, 30a, are each connected to the first and second webs 40a, 42a, respectively. The first and second webs 40a, 42a extend upwardly from the back flanges at an angle to one another forming an elongated generally U-shaped channel 44 therebetween which extends longitudinally along the entire length of the panel 22a. The lowermost back flange 26a is connected to a single second web 42a.

The front flanges 32a–38a are staggered or offset relative to the back flanges 24a–30a so that none directly align with one another. As illustrated in FIG. 2, except for the uppermost front flange 32a, each front flange 34a–38a is connected to the second web 42a of one back flange and the first web 40a of another back flange. For example, intermediate front flange 38a is connected to the first web 40a of intermediate back flange 28a, and to the second web 42a of the intermediate back flange 30a.

In this construction, a portion of each of the front flanges 32a–38a overlies the channels 44 formed by the webs 40a, 42a. For example, a portion of the intermediate front flange 36a overlies the channel 44 formed by the first and second webs 40a, 42a of the intermediate back flange 28a which forms an overhanging lip 48a over such channel 44. Each of the front flanges 32a–38a form an overhanging lip 48a, for purposes to become apparent below.

Figure 3:
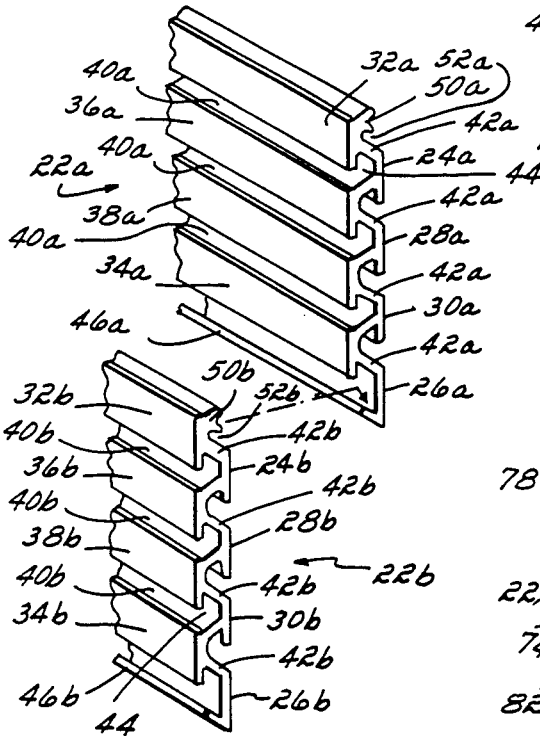
FIG. 3 is a partial perspective, exploded view of the two panels illustrating the structure for interlocking one panel with another.

The modular panels 22a–n are interconnected with one another along the vertical support wall 12 by an interlocking construction of their uppermost front flanges 32a–n and the lowermost back flanges 26a–n. Referring to FIG. 3, the uppermost front flange 32b of modular panel 22b is connected to the uppermost back flange 24b by a second web 42b. An elongated leg 50b is connected to the uppermost front flange 32b and extends rearwardly, at an acute angle relative to the second web 42b, forming a longitudinal slot 52b therebetween. This longitudinal slot 52b is shaped to receive an elongated leg 46a connected to the lowermost back flange 26a of panel 22a.

As illustrated in FIGS. 2 and 3, modular panel 22b is releasably mounted to modular panel 22a by inserting the elongated leg 46a of modular panel 22a into the longitudinal slot 52 formed at the uppermost front flange 32b of modular panel 22b. The elongated leg 46a of panel 22a is angled upwardly relative to the vertical support 12, and the elongated leg 50b of panel 22b is angled downwardly, so that the elongated leg 50b hangs from elongated leg 46a to support panel 22b upon panel 22a. Successive modular panels are interconnected in this fashion, e.g., panel 22c to 22b, so that they hang from one another along their longitudinal edges. The elongated leg 46a of each modular panel 22a–n acts as a stiffening element when interconnected with an associated elongated leg 50b to add rigidity and stability to the overall display.

As shown in FIGS. 1 and 2, a wide space or gap is provided between the upright legs 46a–n and the second webs 42a–n connected to the lowermost back flanges 26a–n of each panel 22a–n. In addition, the elongated legs 50a–n connected to the uppermost front flanges 32a–n of each panel 22a–n are formed at the same angle as the first webs 42a–n. As a result, when adjoining panels 22a and 22b, for example, are mounted to one another by interconnecting legs 46a and 50b, a channel 44 is formed between the elongated leg 50b of panel 22b and the second web 42a of the lowermost back flange 46a of panel 22a which is identical to the other channels 44 on the front face of each panel 22a–n. In this manner, the assembled display apparatus 10 forms joints interconnecting the modular panels 22a–n along their longitudinal edges which are hidden from view.

Articles are supported upon the panels 22a–n by a hook element 54 insertable within the channels 44. The hook element 54 comprises an elongated wire support 56 having legs 57 insertable within a mounting block 58. The mounting block 58 consists of a planar rear face 60 and an upright leg 62 having the same cross section as the channels 44. The hook element 54 is secured to a panel such as panel 22b by tilting the mounting block 58 upwardly so that its upright leg 62 passes underneath the overhanging lip 48b of front flange 32b and enters a channel 44. The hook element 54 is then pivoted downwardly until the rear face 60 of the mounting block 58 rests against a front flange 36b and the upright leg 62 engages the back side of overhanging lip 48b. The upright leg 62 becomes wedged between the retention lip 48b and the walls of channel 44 which positively locks the hook element 54 in place upon panel 22b. This provides a secure support for mounting a variety of objects to panels 22a–n, including heavy objects, which is not easily dislodged and which does not damage the face of the front flanges 32–38.

In the embodiment shown in FIGS. 1 and 2, the modular panels 22a–n are supported upon the vertical support wall 12, or endwall of a room, by a ceiling bracket 64. The ceiling bracket 64 comprises a rear plate 66 having an angled leg 68 at its lowermost end and a perpendicular leg 70 approximately midway therealong. The ceiling bracket 64 is mounted to the support wall 12 by fasteners such as screws 71 so that the perpendicular leg 70 extends just below the ceiling 16 and the rear plate 66 rests against the support wall 12.

The angled leg 68 at the base of rear plate 66 of ceiling bracket 64 is essentially identical to the elongated legs 46a–n formed at the base of the lowermost back flanges 26a–n of modular panels 22a–n, respectively. The modular panel 22a is mounted to the ceiling bracket 64 by inserting the angled leg 68 of ceiling bracket 64 into the longitudinal slot 52a formed at the uppermost front flange 32a of modular panel 22a. The remaining modular panels 22b, *n* are then mounted along support wall 12 in the manner described above.

Preferably, the modular panel 22n is mounted to the support wall 12 at the floor 14 by one or more screws 72. In order to hide the screws 72, a base plate 74 is snap-fitted onto the modular panel 22n. Base plate 74 comprises an outer cover plate 76, a slotted top plate 78 connected to the cover plate 76, two intermediate legs 80, 82 extending inwardly from the cover plate 76 and a bottom leg 84 connected to the cover plate 76. The base plate 74 is attached to the modular panel 22n by inserting the bottom leg 84 against the elongated leg 46n formed at the base of the lowermost back flange 26*n* of panel 22*n*, and then snap fitting the overhanging lip 48*n* of the front flanges 36*n* of panel 22*n* into the slotted top plate 78. The intermediate legs 80, 82 of base plate 74 rest against the intermediate front flanges 38*n*, 34*n*, respectively, with the base plate 74 in position, and act as spacers to retain the base plate 74 on the panel 22*n*.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the scope thereof.

For example, the modular panels of this invention can be arranged to form displays of widely varying height and width, and can be carried by a wide variety of supports in addition to the walls of a room or building as illustrated in the Figures. The modular panels are sufficiently rigid and strong to form a vertical display having supports only at the ends or at the top instead of along the entire length and width of the back flanges of the panels as shown. In addition, the ceiling bracket and base plates illustrated are exemplary of a support for the panels and a means to close the lowermost channel of a panel, respectively. It is contemplated that other support brackets and/or base plates would be suitable for use herein without departing from the scope of the invention.

In the embodiment shown in the Figures, only the lowermost panel 22*n* is directly secured to the support wall 12 by fasteners such as screws 72. It is contemplated, however, that in some applications additional support will be needed to prevent buckling of the panels relative to one another, particularly in displays of substantial height. Such additional support would be provided in the form of tape or other attachment means extending between adjacent panels along their adjoining longitudinal edges on the rear or back surface of the panels. Alternatively, each panel 22*a–n* could be fastened by screws 72 or the like directly to the vertical support 12.

Therefore, it is intended that the invention not be limited to the particular embodiment disclosed as the best mode contemplated for carrying out this invention, but that the invention will include all embodiments falling within the scope of the appended claims.

What is claimed is:

1. A display panel comprising:

a back surface;

a plurality of first and second web pairs spaced along said back surface, each pair of said first and second webs extending outwardly from said back surface at an angle relative to one another forming a channel therebetween;

a plurality of spaced front flanges extending substantially parallel to said back surface, a first front flange being connected to a first web of one of said web pairs and the remaining front flanges being connected to said first web of one web pair and said second web of an adjacent web pair, said front flanges overlying a portion of its respective underlying channel so that when viewed from said front flanges the viewer sees a series of parallel, spaced longitudinal channels;

first side edge means connected to said first front flange at one end of said back surface and second opposed side edge means connected to the opposite end of said back surface, said first side edge means of one display panel being adapted to engage said second side edge means of another display panel for joining one panel to another panel, said first side edge means of one panel cooperating with an adjacent front flange of said another panel to define a channel substantially identical to said channels in said another panel thereby concealing the joinder of said panels from view.

2. The display apparatus of claim 1 in which said back surface comprises a plurality of spaced back flanges.

3. The display apparatus of claim 2 in which said back flanges are laterally offset relative to said front flanges.

4. A display panel comprising:

a back surface having opposed, first and second side edges;

a plurality of first and second web pairs spaced along said back surface, each pair of said first and second webs extending outwardly from said back surface at an angle relative to one another forming a channel therebetween;

a plurality of spaced front flanges extending substantially parallel to said back surface, a first front flange being connected to a first web of one of said web pairs at said first side edge of said back surface and the remaining front flanges being connected to said first web of one web pair and said second web of an adjacent web pair;

first mounting means connected to said first front flange at said first side edge of said back surface and second, opposed mounting means connected to said second side edge of said back surface, said first mounting means of one display panel being adapted to engage said second mounting means of another display panel for joining one panel to another panel.

5. The display panel of claim 4 wherein:

said first mounting means comprises an elongated first leg connected to said first front flange at said first side edge of said back surface, said elongated first leg extending outwardly at an acute angle relative to said first front flange and being spaced from said first web of one of web pairs to form an elongated slot therebetween;

said second mounting means comprises an elongated second leg connected to one of said back flanges at said second side edge of said back surface, said elongated second leg extending outwardly at an acute angle relative to said one back flange;

said angled, elongated second leg of one modular panel being adapted to be received within said slot and engaging said angled, elongated first leg of another modular panel to join said one modular panel to said another modular panel.

6. An apparatus for displaying and supporting articles, comprising:

a number of modular panels joined together and adapted to be vertically supported, each of said modular panels comprising:

(i) a plurality of spaced, back flanges including opposed, first and second back flanges;

(ii) a first web connected to said said back flange and first and second webs connected to each of the remaining back flanges, said first and second webs extending outwardly from said remaining back flanges at an angle relative to one another forming a channel therebetween;

(iii) a plurality of spaced front flanges including opposed first and second front flanges, said front flanges extending substantially parallel to said back flanges, said first front flange being connected to said first web of said first back flange and the remaining front flanges being connected to said first web of one of said back flanges and said second web of an adjacent back flange;

(iv) first mounting means connected to said first front flange and second mounting means connected to said second back flange of each modular panel, said first mounting means of one modular panel being adapted to engage said second mounting means of another modular panel to join said one modular panel to said another modular panel.

7. An apparatus for displaying and supporting articles, comprising:

a number of modular panels joined together and adapted to be vertically supported, each of said modular panels comprising:

(i) a plurality of spaced, back flanges including opposed first and second back flanges;

(ii) a first web connected to said second back flange and first and second webs connected to each of the remaining back flanges, said first and second webs extending outwardly from said remaining back flanges at an angle relative to one another forming a channel therebetween;

(iii) a plurality of spaced front flanges including opposed first and second front flanges, said front flanges extending substantially parallel to said back flanges, said first front flange being connected to said first web of said first back flange and the remaining front flanges being connected to said first web of one of said back flanges and said second web of an adjacent back flange;

(iv) first mounting means connected to said first front flange and second mounting means connected to said second back flange of each modular panel, said first mounting means of one modular panel being adapted to engage said second mounting means of another modular panel to join said one modular panel to said another modular panel;

means for mounting at least one of said modular panels to the vertical support;

means for supporting articles upon said modular panels; and means for covering at least the bottom channel of the lowermost panel mounted to the vertical support.

8. The apparatus of claim 7 in which a portion of each said front flanges overlies a channel to form an overhanging, retention lip, said means for supporting articles upon said modular panels being a hook element comprising:

an elongated support portion for supporting articles to be displayed;

a mounting block formed with a planar front face, an upright hook portion and means for releasably securing said elongated support portion thereto;

said mounting block being supported upon a modular panel so that said upright hook portion engages said retention lip of one of said front flanges and extends into a channel formed by said first and second webs of a back flange filling said channel, and said planar front face of said mounting block rests against the face of another front flange.

9. The apparatus of claim 7 in which said means for mounting at least one modular panel to the vertical support is a ceiling bracket comprising:

a back plate adapted to mount to the vertical support;

an elongated leg connected to said back plate, said elongated leg extending outwardly at an acute angle relative to said back plate;

said first mounting means connected to said first front flange of one panel being adapted to be joined to said elongated leg of said ceiling bracket to mount said modular panel along the vertical support wall forming a channel substantially identical to said channels in said one panel thereby concealing the joinder of said one panel to said ceiling bracket.

10. The apparatus of claim 7 in which a portion of each of said front flanges overlies said channel to form a retention lip, said means for covering at least the bottom channel of the lowermost panel mounted to the vertical support comprising:

an outer cover plate adapted to engage the floor at the base of the vertical support;

a top plate connected to the upper end of said outer plate, said top plate being formed with a slot for engaging said retention lip of one of said front flanges of the lowermost modular panel; and a bottom leg connected to said outer plate, said bottom leg engaging said elongated first leg formed on said lowermost back flange of said lowermost modular panel.

* * * * *